US008317552B2

(12) United States Patent
Leroyer et al.

(10) Patent No.: US 8,317,552 B2
(45) Date of Patent: Nov. 27, 2012

(54) FEMALE ELECTRICAL CONTACT, CONNECTOR UNIT, AND PROCESS FOR PRODUCTION

(75) Inventors: Serge Leroyer, Le Mans (FR); Pascal Ribeau, Le Mans (FR)

(73) Assignee: SOURIAU, Versailles (FR)

( * ) Notice: Subject to any disclaimer, the term of this patent is extended or adjusted under 35 U.S.C. 154(b) by 0 days.

(21) Appl. No.: 13/217,399

(22) Filed: Aug. 25, 2011

(65) Prior Publication Data

US 2012/0052750 A1 Mar. 1, 2012

(30) Foreign Application Priority Data

Aug. 27, 2010 (FR) ..... 10 56810

(51) Int. Cl.
*H01R 4/48* (2006.01)

(52) U.S. Cl. ..... 439/839

(58) Field of Classification Search ..... 439/839, 439/851

See application file for complete search history.

(56) References Cited

U.S. PATENT DOCUMENTS

| | | | | | |
|---|---|---|---|---|---|
| 1,677,068 | A | * | 7/1928 | Alden | 439/839 |
| 2,346,831 | A | * | 4/1944 | Drury | 439/839 |
| 3,229,243 | A | * | 1/1966 | Gomulka | 439/733.1 |
| 3,586,802 | A | * | 6/1971 | Nichols et al. | 218/90 |
| 3,924,922 | A | * | 12/1975 | DeCenzo | 439/839 |
| 4,035,045 | A | * | 7/1977 | Trevithick | 439/101 |
| 4,168,878 | A | * | 9/1979 | Risser et al. | 439/200 |
| 4,192,572 | A | * | 3/1980 | Stanger et al. | 439/185 |
| 4,341,434 | A | * | 7/1982 | Pfister | 439/839 |
| 4,412,718 | A | * | 11/1983 | Pfister | 439/839 |
| 4,550,972 | A | * | 11/1985 | Romak | 439/839 |
| 4,591,222 | A | * | 5/1986 | Shaffer | 439/265 |
| 4,634,201 | A | | 1/1987 | Kemka | |
| 4,655,526 | A | * | 4/1987 | Shaffer | 439/268 |
| 4,917,630 | A | * | 4/1990 | Hubbard | 439/578 |
| 4,938,720 | A | * | 7/1990 | Romak | 439/839 |
| 5,277,605 | A | * | 1/1994 | Roscizewski et al. | 439/184 |
| 5,413,503 | A | * | 5/1995 | Salz | 439/578 |
| 5,468,164 | A | * | 11/1995 | Demissy | 439/843 |
| 5,486,124 | A | * | 1/1996 | Wandler | 439/843 |
| 5,525,069 | A | * | 6/1996 | Roscizewski et al. | 439/184 |

(Continued)

FOREIGN PATENT DOCUMENTS

CN 201 038 406 3/2008

(Continued)

OTHER PUBLICATIONS

French Search Report dated Apr. 1, 2011, corresponding to the priority application.

*Primary Examiner* — Amy Cohen Johnson
*Assistant Examiner* — Vladimir Imas
(74) *Attorney, Agent, or Firm* — Young & Thompson

(57) ABSTRACT

A female electrical contact (100) has one connecting end (102) which is able to have two states, respectively a non-stressed state, and a stressed state, in which a connecting diameter is reduced, for receiving and maintaining the connection with a mating electrical contact. An annular gorge (107) in an undercut is provided on the wall (105) of the female electrical contact, such that in the non-stressed state, it has a tapered longitudinal cross-section, and in the stressed state, it has a straight longitudinal cross-section. A connector unit that includes at least one such contact, and a process for production are also described.

12 Claims, 3 Drawing Sheets

U.S. PATENT DOCUMENTS

| | | | | |
|---|---|---|---|---|
| 5,785,560 | A * | 7/1998 | Akamatsu | 439/851 |
| 5,938,486 | A * | 8/1999 | Durand-Cochet et al. | 439/839 |
| 6,827,608 | B2 * | 12/2004 | Hall et al. | 439/578 |
| 6,899,572 | B1 * | 5/2005 | Baker et al. | 439/851 |
| 7,094,114 | B2 * | 8/2006 | Kurimoto | 439/839 |
| 7,658,657 | B1 * | 2/2010 | Scanzillo et al. | 439/825 |
| 7,837,519 | B2 * | 11/2010 | Copper et al. | 439/839 |
| 2007/0190868 | A1 * | 8/2007 | De Cloet et al. | 439/851 |
| 2009/0278788 | A1 * | 11/2009 | Takata et al. | 345/102 |

FOREIGN PATENT DOCUMENTS

| | | |
|---|---|---|
| JP | 2009 054374 | 3/2009 |

* cited by examiner

FEMALE ELECTRICAL CONTACT, CONNECTOR UNIT, AND PROCESS FOR PRODUCTION

FIELD OF THE INVENTION

The invention relates to a female electrical contact that is designed to be equipped, around one of its connecting ends, with a tightening element that can keep said connecting end in a stressed state in order to reduce its connecting diameter. More particularly, the invention relates to a housing that is provided on the wall of the electrical contact and that is designed to receive and keep in position said tightening element. The invention also relates to a connector unit that comprises at least one such female electrical contact. The invention also relates to a process for production of such a female electrical contact.

BACKGROUND OF THE INVENTION

In the field of connection technology, it is sometimes necessary, in particular for uses in aeronautics and in the automotive industry, to use connecting elements that can maintain their electrical connections under extreme conditions. Actually, the electrical connections can be subjected to strong vibrations and/or elevated temperature differentials, tending to deteriorate the electrical connection between two mating contacts.

In general, one connecting end of a female electrical contact or socket is specifically sized to receive a mating male contact or pin. The materials that are used, namely copper alloys such as brass or bronze, are selected for their ability to maintain their mechanical characteristics at temperature so as to prevent untimely expansions from breaking the electrical connection.

Most of these materials most often have a loss of their elasticity when they are subjected to temperatures of greater than 200° C., such that when the pin is introduced into the socket, there is not necessarily a sufficient tightening of said socket around said pin when the temperature approaches or exceeds 200° C.

Also, it is known to use a female electrical contact, or socket, such as a female power contact, equipped with an annular tightening element, so as to tighten the wall of the socket around the pin and thus promote maintaining the electrical connection even in the case of strong vibrations and/or high temperatures.

The characteristics of the materials used for this annular tightening element are such that their elasticity is maintained for temperatures of greater than 200° C.

FIG. 1 shows a partial longitudinal cutaway of such a female electrical contact 1 at the end of the tightened connection 6.

DETAILED DESCRIPTION OF THE INVENTION

More specifically, the socket 1 comprises a socket body 2 that has a general cylindrical circular shape. Longitudinal slots are made in the socket body, extending along the longitudinal axis A, from the opening 11 of the connecting end 6 and over a partial length of the socket body 2. In general, at least two longitudinal slots are made on the connecting end 6.

Only the connecting end 6 under consideration has been tightened in such a way as to have a connecting diameter DA, corresponding to the inside diameter at the opening 11 of said end 6, reduced relative to the inside diameter DB of the rest of the socket body 2. The diameter DA is bordered by the inside surface 9 of the wall 5 of the female contact 1.

The connecting diameters DA and DB are determined based on the diameter D of the pin that is to be introduced in such a way as to have DA<D<DB. Actually, the inside surface 9 of the wall 5 at the connecting end 6 is to be attached with pressure to the outside wall of the pin, and this pressure is to be maintained so as to ensure the electrical connection between these two elements. Thus, the deformation is such that the connecting end 6 has a tapered longitudinal cross-section, with the inside diameter of the cavity increasing from the connecting diameter DA at the opening 11 toward DB at the bottom of the cavity.

An annular groove 3 is hollowed out from the outside surface 4 of the wall 5 of the socket body 2 to receive a tightening ring. The groove 3 extends over the entire outside perimeter of the connecting end 6 of the socket 1. Lips of stop 8 are provided upstream from the groove 3. Thus, the groove 3 is bordered upstream by the lips of stop 8 and downstream by the wall 5 of the non-machined socket body 2. Upstream and downstream are defined relative to the direction of the connection at the end being considered.

A bottom 7 of the groove 3 is inclined by an angle X relative to a longitudinal axis A of the socket body 2, corresponding to the tightening angle applied to the connecting end 6 to obtain the desired connecting diameter DA.

The tightening ring 10 is housed in the groove 3 in such a way as to surround the connecting end 6. The tightening ring 10 conventionally has a tubular shape and has a straight cross-section relative to the axis A, such that it does not rest over its entire length on the bottom 7 of the groove 3.

To house the tightening ring 10 in the groove 3, said tightening ring 10 is slid along the wall 5 of the socket body 2, from the lips of stop 8 that border the opening 11.

The tightening ring 10 is therefore to pass above lips of stop 8 before ending in the groove 3. However, an outside diameter D1 of the connecting end 6 at the lips of stop 8 is larger than an inside diameter D2 of the tightening ring 10, since said lips of the stop are to prevent the untimely removal of said tightening ring 10. Inside diameter is defined as the diameter that is measured from the inside surface of the element being considered, while the outside diameter corresponds to the diameter that is measured from the outside surface of the element being considered.

The tightening ring 10 is generally made of material that can withstand high temperatures, while preserving its elastic properties thus providing a spring action.

It often happens that such materials have elastic characteristics over reduced operating ranges and that strong deformations linked to assembly operations make them shift from an elastic range to a plastic range, with the consequent loss of the spring action.

Also, it is common that the stresses imposed on the tightening ring 10 during the shifting of the lips of stop 8, above the diameter D1 in particular, make it shift to the plastic state, taking into account the strong deformation imposed. The tightening ring 10 is then no longer able to correctly perform its function of tightening and maintaining the connecting diameter DA.

In the invention, it is sought to provide a female electrical contact that can be used even under conditions of strong vibrations and high temperatures, not exhibiting all or part of the drawbacks of the female electrical contacts of the prior art.

For this purpose, the invention proposes machining—at the end of the connection of interest—a groove in an undercut, with the angle of the undercut corresponding essentially to the tightening angle to obtain the desired reduced diameter at said connecting end. Undercut is defined as the groove being provided in such a way that its bottom is inclined longitudinally. Thus, the bottom of the groove in an undercut has, before the tightening of the first connecting end, a slope relative to the longitudinal axis of the female electrical contact such that the diameter of the front end of the groove in an undercut is larger than the diameter of the rear end of said groove in an undercut. In a general manner, front and rear, or upstream and downstream, are defined relative to the direction of the connection at the connecting end being considered. The diameter of the groove is considered at the bottom of said groove. Once the tightening is done, the groove has a straight cross-section, parallel to the longitudinal axis of the contact. An annular tightening element, such as a ring, also with a straight cross-section, can then be used in an optimum manner, since its entire surface rests in an equal manner on the bottom of the groove. The diameter of the connecting end at the lips of the stop is reduced relative to the system of the prior art described above, reducing the displacement in order for the tightening element to pass through this stop.

The invention therefore has as its object a female electrical contact with a general cylindrical circular shape that comprises two connecting ends, at least one first connecting end having at least two longitudinal slots, with said first connecting end being able to have two states, respectively a non-stressed state, in which said first connecting end has a straight longitudinal cross-section, and a stressed state, in which said first connecting end has a tapered longitudinal cross-section, with an annular groove being hollowed out from an outside surface of the wall of the female electrical contact, at the first connecting end, designed to receive a tightening element, characterized in that the annular groove has, when the first connecting end is in the non-stressed state, a tapered longitudinal cross-section such that the diameter of a front end of the annular groove is larger than the diameter of a rear end of said annular groove, and in that the annular groove has, when the first connecting end is in the stressed state, a straight cross-section.

The non-stressed state is the state in which the contact is found before being tightened to have a reduced connecting diameter at one of its two connecting ends.

When one of the two connecting ends is deformed/tightened to reduce its opening diameter, the rest of the body of the contact and the second connecting end are not deformed, and it continues to have a cylindrical circular shape. The deformation/stress is only local.

Connecting diameter is defined as the inside diameter of the contact at the connecting end being considered.

Reduced diameter means that the diameter that is being considered is less than the diameter of the rest of the cylindrical circular contact.

The groove extends over a certain length of the connecting end, enough to receive a tightening element that is also annular, able to maintain a tightening pressure around said connecting end and to make it possible to hold the reduced connecting diameter under all circumstances.

Length is defined as the dimension that extends parallel to the longitudinal axis of the element being considered.

The stressed state is obtained mechanically by tightening the opening diameter at the connecting end. The tightening of the connecting end tends to bring the bottom of the groove parallel to the longitudinal axis of the contact. The slope of the groove decreases to almost zero, it being understood that the fact of manufacturing stresses, a slight slope relative to the longitudinal axis in one direction or in the other, may be acceptable.

Longitudinal cross-section is defined as a cross-section in a longitudinal plane of the female electrical contact.

Advantageously, the annular groove has—in the non-stressed state of the first connecting end—a slope that has an angle relative to a longitudinal axis of the female electrical contact that is essentially equal to a tightening angle that has to be applied to the first connecting end to shift to the stressed state and to obtain a reduced connecting diameter.

According to the invention, the female electrical contact can comprise a tightening element that is placed in the annular groove and is able to keep the first connecting end in the stressed state, whereby said tightening element has a straight longitudinal cross-section.

The annular tightening element is designed to be mounted on the connecting end once it is in the constrained/tightened state. Thus, during assembly, because of the initial shape in an undercut of the groove, excessive stresses are not exerted on said ring.

The tightening element is to be able to keep the connecting end in the stressed state even when significant forces are applied, tending to make said connecting end return to a non-stressed state.

Preferably, the tightening element has mechanical properties such as elasticity, which make it particularly suitable for operating at temperatures of more than 200° C.

In one embodiment, the front end of the annular groove is bordered by lips of a stop. These lips of a stop can be obtained by, for example, machining the groove downstream from the opening of the connecting end in such a way that said groove does not protrude at said opening. Thus, the non-hollowed-out wall of the contact, upstream from the groove, forms the lips of the stop. Otherwise, these lips of the stop can be connected to the connecting end and attached in particular by welding.

The groove is thus bordered by two vertical walls, and the outside diameter of the contact at said lips of the stop, as well as downstream from the groove, is larger than the outside diameter of the contact at the bottom of the groove. Likewise, the outside diameter at said lips of the stop, as well as downstream from the groove, is larger than the inside diameter of the tightening element, which ensures—once it is installed—that the tightening element will remain in the proper position in the groove.

The tightening element can be, for example, a slit cylindrical circular ring.

The slot thus makes it possible to facilitate the passage of the lips of the stop without exerting excessive stresses on the ring.

The tightening element can otherwise be a cylindrical circular helical spring, with the manufacturing cost of such a spring often being less.

The invention also relates to a connector unit comprising an insert that is equipped with at least one through cavity, designed to receive two mating electrical contacts, whereby said connector unit comprises at least one female electrical contact, or socket, according to the invention, and at least one mating male electrical contact, or pin, able to be inserted into at least one through cavity of the insert.

The male and female contacts are each introduced into a cavity of the insert that is being considered, by an opposite end, in such a way that a connecting zone between the two mating electrical contacts is located inside said cavity.

The invention also relates to a process for the production of a female contact element according to the invention, comprising the following stages:

A female electrical contact, of general circular cylindrical shape, equipped at each of its ends with a connecting end, is produced to be connected to a mating electrical contact or a cable;

At least one longitudinal slot is machined at a first connecting end;

An annular groove is machined from the outside surface of the wall of the female electrical contact, at the first connecting end, in such a way that a bottom of the groove extends along an axis that is inclined relative to a longitudinal axis of the female electrical contact, such that the diameter of a front end of the annular groove is larger than the diameter of a rear end of said annular groove;

The first connecting end is tightened in such a way as to reduce the connecting diameter at said first connecting end, until the bottom of the groove extends along an axis that is parallel to the longitudinal axis of the female electrical contact;

A tightening element is slid along the outside wall of the female contact until it is housed entirely in the annular groove.

According to an embodiment of the process of the invention, it is possible to provide the following additional stage:

Simultaneously with the annular groove, lips of the stop are provided, upstream from said annular groove, such that the outside diameter of the female electrical contact at said lips of the stop is larger than the outside diameter of the female electrical contact at the bottom of the groove and larger than the inside diameter of the tightening element.

BRIEF DESCRIPTION OF THE DRAWING

The invention will be better understood from reading the following description and from the examination of the accompanying figures. The latter are presented by way of indication and are in no way limiting of the invention. The figures show:

For the purpose of simplifying and clarifying the figures, the same references in different figures designate the same elements.

FIG. 2 shows an embodiment of a female electrical contact 100 according to the invention.

Figure 1:
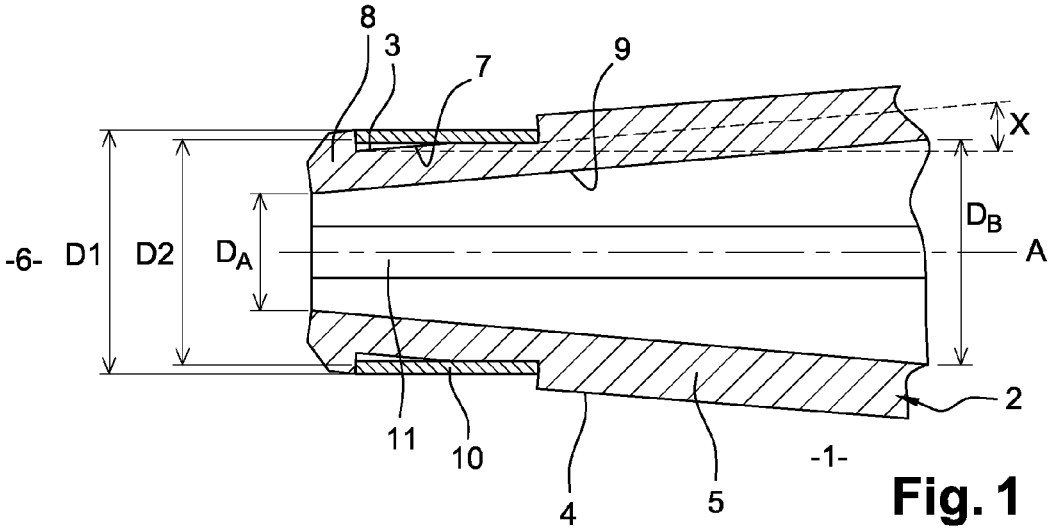
FIG. 1: A longitudinal cutaway view of a connecting end of a female electrical contact of the prior art already described.

The female electrical contact 100, or socket, comprises a socket body 101, with a general hollow cylindrical shape with a circular cross-section, or a cylindrical circular cross-section. The two ends 102, 103 of the cylinder are open and provide connecting ends, each designed to receive a mating male electrical contact, or pin, or a cable. The connecting end 102 that is designed to receive a pin (at the right in FIG. 2) is slit longitudinally. The two slots 104 make it possible to facilitate the tightening of said end 102, without an overlapping of material.

A wall 105 of the socket body 101 is hollowed out from an outside surface 106 in such a way as to provide an annular groove 107 in an undercut. A slit annular tightening element 108 surrounds an outside perimeter of the socket body 101. The tightening ring 108 is more specifically housed in the annular groove 107, in which it is held in position, in particular using lips of stop 109.

Figure 3A:
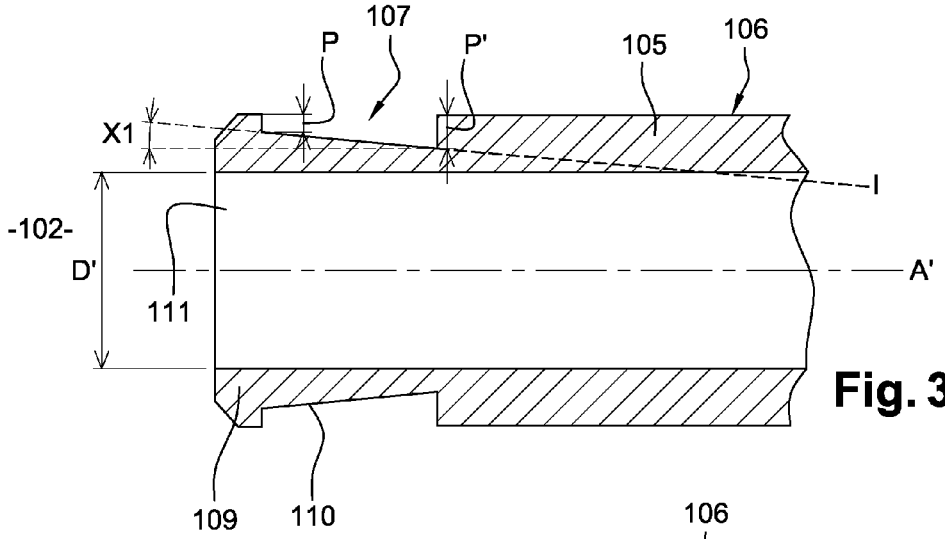
FIGS. 3A to 3C: Longitudinal cutaway views of a connecting end of a female electrical contact according to the invention.
Figure 3B:
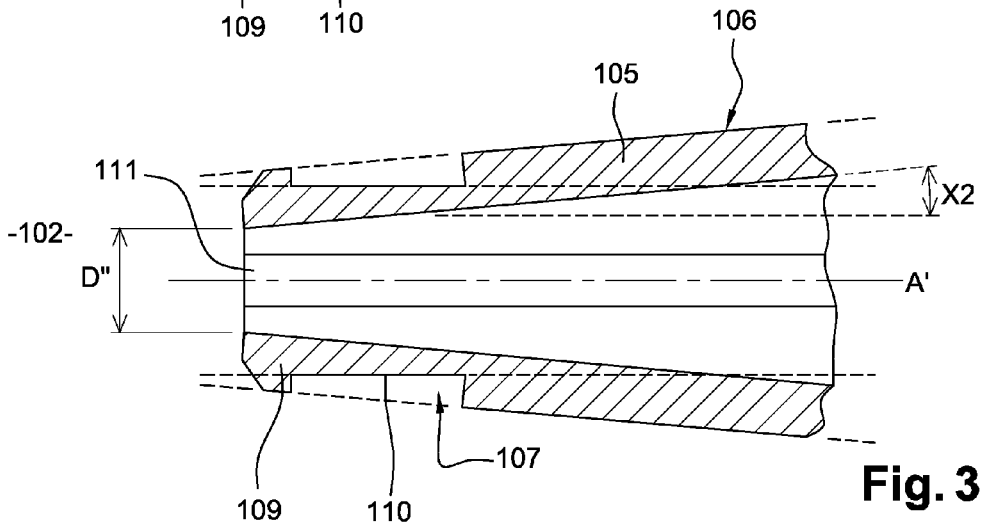
Figure 3C:
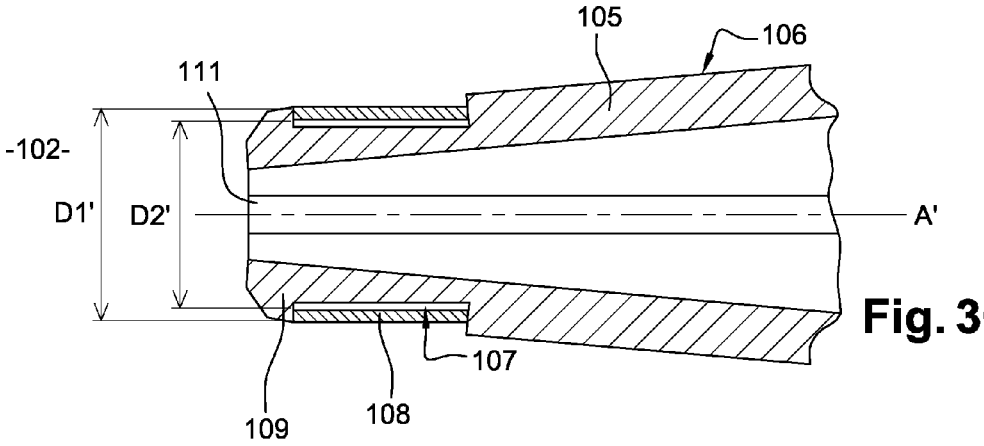

FIGS. 3A, 3B and 3C show more precisely the shape of the undercut of the annular groove 107 (FIG. 3A) in the non-stressed state (FIG. 3A), and the shape of the straight cross-section of said annular groove 107 in the stressed state (FIGS. 3B and 3C).

In a first step, the annular groove 107 is hollowed out or machined on the socket body 101, on a slant from the outside surface 106 of the wall 105, which it extends essentially parallel to a longitudinal axis A' of the socket body 101. Thus, an upstream depth p of the annular groove 107 is less than a downstream depth p' of said groove 107. Depth is defined as the dimension that extends radially relative to the axis A'. In other words, the outside diameter at the upstream level of the annular groove 107 is larger than the outside diameter at the downstream level of the annular groove 107. The bottom 110 of the groove 107, flat, extends along an axis I that is inclined by an angle X1 relative to the longitudinal axis A'. An inside diameter D' of the opening 111 of the connecting end 102 corresponds to the general inside diameter of the socket body 101.

The angle X1 is advantageously predetermined based on the tightening angle X2 that will next be applied at the connecting end 102, in such a way that once the tightening is carried out, the bottom 110 of the groove 107 extends essentially parallel to the axis A' of the contact 100. The tightening angle X2 should correspond to the angle to be applied to obtain a reduced connecting diameter D" (FIG. 3B) that can allow the electrical connection with a mating male contact. The reduced connecting diameter D" corresponds to the inside diameter of the connecting end at the opening 111. In a general manner, according to the invention, the angle X1 is essentially equal to the tightening angle X2.

The groove 107 is produced at a distance from the opening 111 of the connecting end 102 in such a way as to provide lips of stop 109 upstream from the groove 107.

Next, the connecting end 102 is tightened in such a way as to reduce the diameter of the opening 111 until the reduced diameter D" corresponding to the desired diameter is obtained based on the dimensions of the pin that is to be inserted. The wall 105 of the socket body 101 is thus locally inclined by the angle X2, while the bottom 110 of the groove 107 is itself parallel to the axis A'. Also, the outside diameter at the annular groove 107 is constant over its entire length. Length is defined as the dimension that extends essentially parallel to the longitudinal axis A'.

Figure 2:
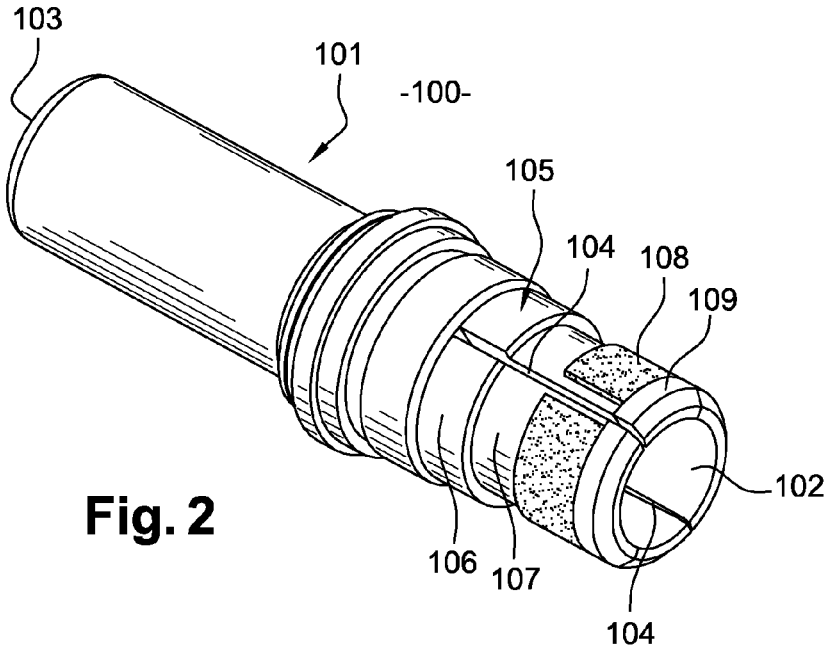
FIG. 2: A general view of a female electrical contact according to the invention.

The longitudinal cross-section of the connecting end 102 is then tapered. The inside diameter like the outside diameter of the connecting end are increasing from the opening 111 that has the reduced inside diameter D" to a separation partition 112 (FIG. 4) that separates the two connecting ends 102, 103. The rest of the socket body 101, as is visible in FIG. 2, is not deformed by this tightening stage of the connecting end 102, whose inside diameter remains equal to the initial diameter D'.

Once the reduced diameter D" is obtained, the tightening ring 108 is brought opposite the opening 111 of the connecting end 102. The passage of said tightening ring 108 is forced at the opening 111 so as to make it overlap the lips of stop 109. Actually, the connecting end 102 has—at the lips of stop 109—an outside diameter D1' that is larger than the inside diameter D2' of the tightening ring 108. However, according to the invention, with the groove 107 that at this time has a straight cross-section, the outside diameter D1' at the lips of the stop of the socket 100 is strictly smaller than the outside diameter D1 at the lips of the stop of a socket 1 (FIG. 1) of the prior art of equivalent dimensions.

Thus, in a general manner, the difference in diameter between D1' and D2' is between 0.2 mm and 0.8 mm, whereas for a socket 1 of the prior art, the difference in diameter between D1 and D2 (FIG. 1) is, by contrast, between 1 mm and 1.2 mm. This difference in the diameter fluctuations makes it possible to prevent the tightening ring 108 from being subjected to stresses as it transitions to a detrimental plastic state. It is therefore possible to use—for the tightening ring 108 or in a general manner for the tightening element—materials that are less elastic, such as simple brasses ensuring a better tightening behavior of the connecting end 102 and thus of the connection between the socket and the associated pin.

The tightening ring 108 is next slid along the outside surface 106 of the wall 105 of the socket body 101 until it is entirely contained in the groove 107 (FIG. 3C).

The upstream depth p and downstream depth p' of the groove 107 are enough to prevent the involuntary withdrawal of the tightening ring 108. With the tightening ring 108 having a straight cross-section, it extends over its entire length parallel to the bottom 110 of the groove 107 in such a way that the stresses exerted by said tightening ring 108 on the connecting end 102 are essentially constant.

Figure 4:
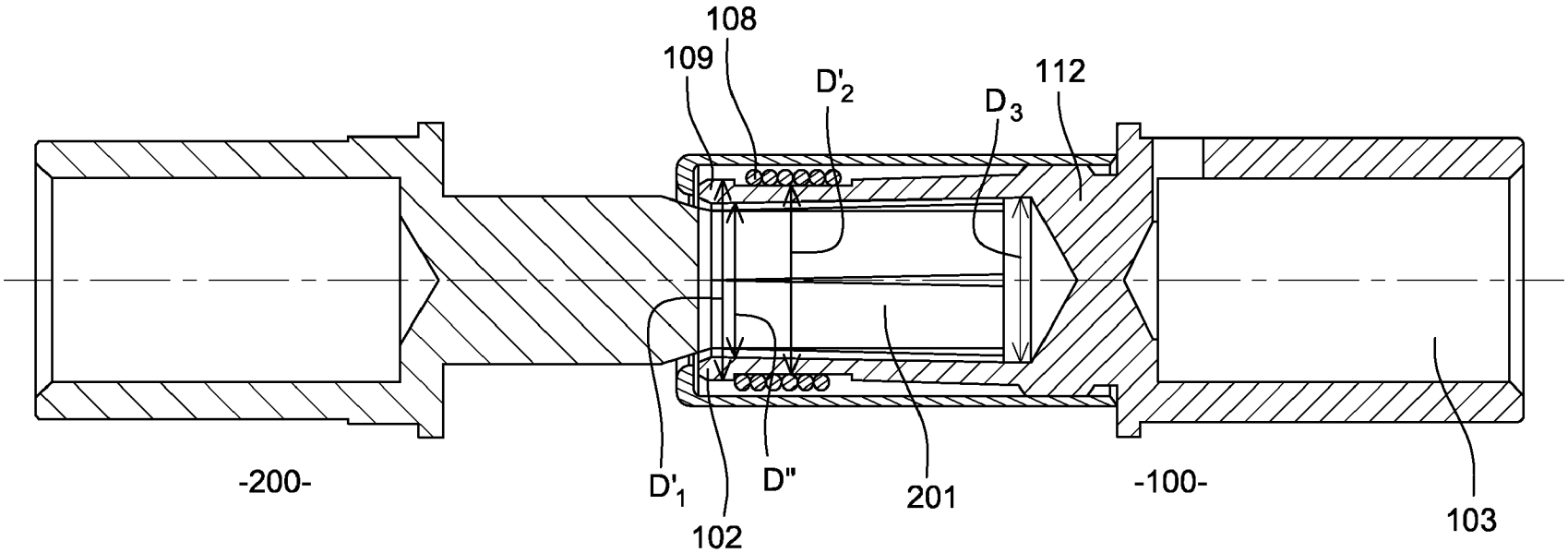
FIG. 4: A longitudinal cutaway view of a female electrical contact according to the invention, connected to a mating male electrical contact.

FIG. 4 shows a female electrical contact 100 according to the invention, connected at one connecting end 102 with a reduced connecting diameter to a mating male electrical contact 200.

The largest outside diameter D3 of the male contact 200, at the connecting end 201 inserted into the reduced connecting end 102, is 5.41 mm. The outside diameter D1' at the lips of stop 109 is 6.8 mm, while the inside diameter D2' of the tightening element 108 (here a cylindrical circular helical spring) is 6.5 mm. The reduced connecting diameter D", corresponding to the smallest diameter of the connecting end 102, located at the opening 111 of said connecting end 102, is 5.4 mm.

Thus, the male contact 200 is introduced in force in the connecting end 102 of the female contact 100, and the tightening element 108 ensures that the reduced connecting diameter D" is maintained.

The invention claimed is:

1. A female electrical contact (100) with a general cylindrical circular shape that comprises two connecting ends (102, 103), at least one first connecting end having at least two longitudinal slots, with said first connecting end being able to have two states, respectively a non-stressed state, in which said first connecting end has a straight, longitudinal cross-section, and a stressed state, in which said first connecting end has a tapered longitudinal cross-section, with an annular groove (107) being hollowed out from an outside surface (106) of the wall (105) of the female electrical contact, at the first connecting end, designed to receive a tightening element (108), characterized in that the annular groove has, when the first connecting end is in the non-stressed state, a tapered longitudinal cross-section such that the diameter of a front end of the annular groove is larger than the diameter of a rear end of said annular groove, and in that the annular groove has, when the first connecting end is in the stressed state, a straight cross-section; and wherein the annular groove has—in the non-stressed state of the first connecting end—a slope that has an angle (X1) relative to a longitudinal axis (A') of the female electrical contact that is essentially equal to a tightening angle (X2) that has to be applied to the first connecting end to shift to the stressed state and to obtain a reduced connecting diameter (D").

2. The female electrical contact according to claim 1, wherein it comprises the tightening element (108) that is placed in the annular groove and that is able to maintain the first connecting end in the stressed state, whereby said tightening element has a straight cross-section.

3. The female electrical contact according to claim 2, wherein the tightening element comprises a slit cylindrical circular ring.

4. The female electrical contact according to claim 2, wherein the tightening element comprises a cylindrical circular helical spring.

5. The female electrical contact according to claim 1, wherein the front end of the annular groove is bordered by the lips of stop (109).

6. A connector unit comprising an insert that is equipped with at least one through cavity, designed to receive two mating electrical contacts, whereby said connector unit comprises at least one female electrical contact (100) according to claim 1, and at least one mating male electrical contact (200), able to be inserted into at least one through cavity of the insert.

7. A process for the production of a female contact element according to claim 1, comprising the following stages:

a female electrical contact (100), of general circular cylindrical shape, equipped at each of its ends with a connecting end (102, 103), is produced to be connected to a mating electrical contact or a cable;

at least one longitudinal slot is machined at a first connecting end;

an annular groove (107) is machined from the outside surface (106) of the wall (105) of the female electrical contact, at the first connecting end (102), in such a way that a bottom (110) of the groove extends along an axis (1) that is inclined relative to the longitudinal axis (A') of the female electrical contact, such that the diameter of a front end of the annular groove is larger than the diameter of a rear end of said annular groove;

the first connecting end is tightened in such a way as to reduce the connecting diameter at said first connecting end, until the bottom of the groove extends along an axis that is parallel to the longitudinal axis of the female electrical contact;

the tightening element (108) is slid along the outside wall of the female contact until it is housed entirely in the annular groove.

8. A process for the production of a female contact element according to claim 7, comprising the following additional stage:

simultaneously with the groove, lips of stop (109) are provided, upstream from said annular groove, such that the diameter (D1') of the female electrical contact at said lips of the stop is larger than the diameter (D2') of the tightening element.

9. The female electrical contact according to claim 1, wherein it comprises the tightening element (108) that is placed in the annular groove and that is able to maintain the first connecting end in the stressed state, whereby said tightening element has a straight cross-section.

10. The female electrical contact according to claim 9, wherein the tightening element comprises a slit cylindrical circular ring.

11. The female electrical contact according to claim 9, wherein the tightening element comprises a cylindrical circular helical spring.

12. The female electrical contact according to claim 1, wherein the front end of the annular groove is bordered by the lips of stop (109).

* * * * *